US006518505B1

(12) United States Patent
Matsui et al.

(10) Patent No.: US 6,518,505 B1
(45) Date of Patent: Feb. 11, 2003

(54) ULTRAFINE COPPER ALLOY WIRE AND PROCESS FOR PRODUCING THE SAME

(75) Inventors: Hakaru Matsui, Ibaraki (JP); Takaaki Ichikawa, Ibaraki (JP); Koichi Tamura, Ibaraki (JP); Seigi Aoyama, Ibaraki (JP); Osamu Seya, Ibaraki (JP); Ryohei Okada, Ibaraki (JP)

(73) Assignee: Hitachi Cable, Ltd., Tokyo (JP)

( * ) Notice: Subject to any disclaimer, the term of this patent is extended or adjusted under 35 U.S.C. 154(b) by 0 days.

(21) Appl. No.: 09/714,668

(22) Filed: Nov. 17, 2000

(30) Foreign Application Priority Data

Nov. 19, 1999 (JP) ..... 11-330011

(51) Int. Cl.[7] ..... H01B 1/02
(52) U.S. Cl. ..... 174/126.1
(58) Field of Search ..... 174/126.1, 126.2, 174/128.1, 102 R, 106 R

(56) References Cited

U.S. PATENT DOCUMENTS 4,970,112 A * 11/1990 Hayami ..... 428/314.4
5,024,814 A * 6/1991 Futatasuka et al. ..... 420/473
5,443,905 A * 8/1995 Sawada et al. ..... 174/126.1 X
5,463,188 A * 10/1995 Nohmi et al. ..... 174/102 R X
6,148,510 A * 11/2000 Yokoi et al. ..... 29/828

FOREIGN PATENT DOCUMENTS

JP 04146210 5/1992

* cited by examiner

*Primary Examiner*—Chau N. Nguyen
(74) *Attorney, Agent, or Firm*—Antonelli, Terry, Stout & Kraus, LLP

(57) ABSTRACT

An ultrafine copper alloy wire drawn to a diameter of not more than 0.08 mm is provided which is formed of an alloy having a copper matrix of high purity copper with a total unavoidable impurity content of not more than 10 mass ppm. Contained in the matrix is 0.05 to 0.9 mass % of at least one metallic element selected from the group including tin, indium, silver, antimony, magnesium, aluminum, and boron. By virtue of this constitution, the ultrafine copper alloy wire has excellent tensile strength, electrical conductivity, and drawability.

10 Claims, 1 Drawing Sheet

ULTRAFINE COPPER ALLOY WIRE AND PROCESS FOR PRODUCING THE SAME

FIELD OF THE INVENTION

The invention relates to an ultrafine copper alloy wire and a process for producing the same, and more particularly to an ultrafine copper alloy wire having a diameter of not more than 0.08 mm for use, for example, in electronic equipment, IC testers, and medical ultrasound system, and a process for producing the same.

BACKGROUND OF THE INVENTION

A reduction in size of electronic equipment, IC testers, medical ultrasound system and the like has led to a demand for a reduction in diameter of electric wires for these types of equipment. In particular, in the case of electric wires for medical ultrasound system, there is a demand for electric wires (cables) which have an increased number of wire cores (micro coaxial cables) while maintaining the outer diameter of conventional electric wires.

An example of a material for conductors of electric wires for medical ultrasound system currently in use in practical applications is a dilute copper alloy comprising an oxygen-free copper (OFC) as a base metal and a very small amount of a metallic element, such as tin, added to the base metal. The dilute copper alloy is melted and cast into a wire rod which is then drawn through a die to a diameter of 0.03 mmϕ to prepare an ultrafine copper alloy wire. This ultrafine copper alloy wire is mainly used as conductors in electric wires for medical ultrasound system.

When an ultrafine copper alloy wire having a smaller diameter (for example, not more than 0.025 mmϕ) is formed as a conductor for electric wires from the viewpoint of further reducing the diameter of wire cores for medical ultrasound system, however, excessively low breaking strength of the conductors using the conventional copper alloy causes frequent breaking of wires at the time of wire drawing or standing of the conductors. For this reason, the formation of ultrafine copper alloy wires having a diameter of not more than 0.025 mmϕ using conventional alloys was very difficult.

Thus, ultrafine copper alloy wires having higher tensile strength have been desired. Merely increasing the tensile strength, however, results in lowered electrical conductivity. This had led to a demand for copper alloys having both high tensile strength and high electrical conductivity.

Further, excellent drawability is required for the formation of ultrafine copper alloy wires having a diameter of not more than 0.025 mmϕ. When a wire rod is drawn by dicing, the presence of foreign materials having a size of about one-third of the wire diameter in the wire rod poses a problem of wire breaks. Therefore, the amount of foreign materials contained in the wire rod should be reduced to improve the wire drawability.

Detailed analysis of the foreign materials contained in a sample of a broken wire has revealed that the cause of the inclusion of foreign materials in the wire rod is classified roughly into two routes. One of them is inclusions contained in the copper alloy as a base material and the metallic elements as the additive, and peeled pieces produced by the separation of refractories such as SiC, $SiO_2$, and $ZrO_2$, which are components of ceramics and cement used in crucibles employed in melting and/or molds used in casting. The other route is foreign materials externally included during wire drawing. Among these foreign materials, the inclusion of the latter type of foreign materials can be reduced by performing the step of wire drawing in a clean environment.

On the other hand, improving the quality of the base material (improving the purity of substances constituting the base material) is necessary for reducing the amount of the former type of foreign materials (inclusions and peeled pieces). Therefore, when ultrafine wires are formed by wire drawing, very careful attention should be paid so as to avoid the inclusion of foreign materials in steps from melting to wire drawing, and the factor in the inclusion of the foreign material should be minimized.

SUMMARY OF THE INVENTION

The invention has been made with a view to solving the above problems of the prior art, and it is an object of the invention to provide an ultrafine copper alloy, wire having excellent tensile strength, electrical conductivity, and drawability, and a process for producing the same.

According to the first feature of the invention, there is provided an ultrafine copper alloy wire drawn to a diameter of not more than 0.08 mm, said ultrafine copper alloy wire being formed of an alloy comprising a copper matrix of high purity copper with a total unavoidable impurity content of not more than 10 mass ppm and, contained in the matrix, 0.05 to 0.9 mass % of at least one metallic element selected from the group consisting of tin, indium, silver, antimony, magnesium, aluminum, and boron.

According to the second feature of the invention, there is provided an ultrafine copper alloy wire comprising: a core wire formed of an alloy and drawn to a diameter of not more than 0.08 mm, said alloy comprising a copper matrix of high purity copper with a total unavoidable impurity content of not more than 10 mass ppm and, contained in the matrix, 0.05 to 0.9 mass % of at least one metallic element selected from the group consisting of tin, indium, silver, antimony, magnesium, aluminum, and boron; and, provided on the periphery of the core wire, a tin plating, a silver plating, a nickel plating, a tin-lead solder plating, a tin-copper-bismuth-base plating, or a tin-silver-copper-base lead-free solder plating.

The above constitutions can realize ultrafine copper alloy wires having high tensile strength and high electrical conductivity.

According to the third feature of the invention, there is provided a process for producing an ultrafine copper alloy wire to be drawn to a diameter of not more than 0.08 mm, comprising the steps of: melting an alloy in a carbon crucible, said alloy comprising a copper matrix of high purity copper with a total unavoidable impurity content of not more than 10 mass ppm and, contained in the matrix, 0.05 to 0.9 mass % of at least one metallic element selected from the group consisting of tin, indium, silver, antimony, magnesium, aluminum, and boron; and casting the molten alloy by means of a carbon mold.

In this production process, preferably, the casting is carried out by continuous casting to form a wire rod which is subjected to primary wire drawing, annealing, and then secondary wire drawing.

The production process according to the third feature of the invention can provide ultrafine copper alloy wires having high tensile strength and high electrical conductivity and, in addition, good drawability.

According to the fourth feature of the invention, there is provided an electric wire comprising a plurality of ultrafine copper alloy wires stranded together, said ultrafine copper alloy wires each having been drawn to a diameter of not more than 0.08 mm and being formed of an alloy comprising a copper matrix of high purity copper with a total unavoidable impurity content of not more than 10 mass ppm and, contained in the matrix, 0.05 to 0.9 mass % of at least one metallic element selected from the group consisting of tin, indium, silver, antimony, magnesium, aluminum, and boron.

According to the fifth feature of the invention, there is provided an electric wire comprising a plurality of ultrafine copper alloy wires stranded together, said ultrafine copper alloy wire comprising: a core wire formed of an alloy and drawn to a diameter of not more than 0.08 mm, said alloy comprising a copper matrix of high purity copper with a total unavoidable impurity content of not more than 10 mass ppm and, contained in the matrix, 0.05 to 0.9 mass % of at least one metallic element selected from the group consisting of tin, indium, silver, antimony, magnesium, aluminum, and boron; and, provided on the periphery of the core wire, a tin plating, a silver plating, a nickel plating, a tin-lead solder plating, a tin-copper-bismuth-base plating, or a tin-silver-copper-base lead-free solder plating.

The fourth and fifth features of the invention having the above respective constitutions can provide electric wires using ultrafine copper alloy wires, wherein, despite the same outer diameter as the conventional electric wires, the number of wire cores is larger than that of the conventional electric wires.

According to the sixth feature of the invention, there is provided a micro coaxial cable comprising:

an inner conductor comprising a plurality of ultrafine copper alloy wires, according to the first or second feature of the invention, stranded together;

an insulation covering the inner conductor;

an outer conductor comprising a plurality of ultrafine copper alloy wires spirally wound on the insulation at predetermined pitches; and a jacket as the outermost layer of the micro coaxial cable.

In this micro coaxial cable, the ultrafine copper alloy wire constituting the outer conductor is preferably one according to the first or second feature of the invention.

The reasons for the limitation of numeral value ranges as described above will be explained.

The total content of unavoidable impurities in the high purity copper is limited to not more than 10 mass ppm from the viewpoint of minimizing the amount of inclusions in the high purity copper.

The amount of the metallic element contained in the copper matrix in the high purity copper is limited to 0.05 to 0.9 mass %. When the amount of the metallic element contained in the copper matrix is less than 0.05 mass %, a tensile strength of not less than 700 MPa cannot be ensured. On the other hand, the amount of the metallic element is larger than 0.9 mass %, an electrical conductivity of not less than 70% IACS cannot be ensured.

The reason why the tensile strength of not less than 700 MPa is required is as follows. When the tensile strength is less than 700 MPa, due to the very small wire diameter, the wires cannot withstand the stress applied at the time of producing stranded wires or at the time of extrusion of an insulation, leading to a fear of wire breaking. Further, in this case, the bending fatigue lifetime is not likely to be satisfactorily high as conductors.

The reason why the electrical conductivity of not less than 70% IACS is required, is that, when the electrical conductivity is less than 70% IACS, the transmission loss is large at the time of the flow of a high frequency current.

The diameter of the ultrafine copper alloy wire after drawing is limited to not more than 0.08 mm. When the wire diameter is larger than 0.08 mm, even conventional materials can provide extrafine copper alloy wires which can satisfy a tensile strength of not less than 700 MPa and an electrical conductivity of not less than 70% IACS and, at the same time, have good drawability.

The material constituting the crucible and the mold should be a carbon, from the viewpoint of avoiding the inclusion of pieces peeled from the crucible and the mold in the molten metal and the cast material during melting and casting.

BRIEF DESCRIPTION OF THE DRAWING

The invention will be explained in more detail in conjunction with the appended drawing, wherein.

DESCRIPTION OF THE PREFERRED EMBODIMENT

Figure 1:
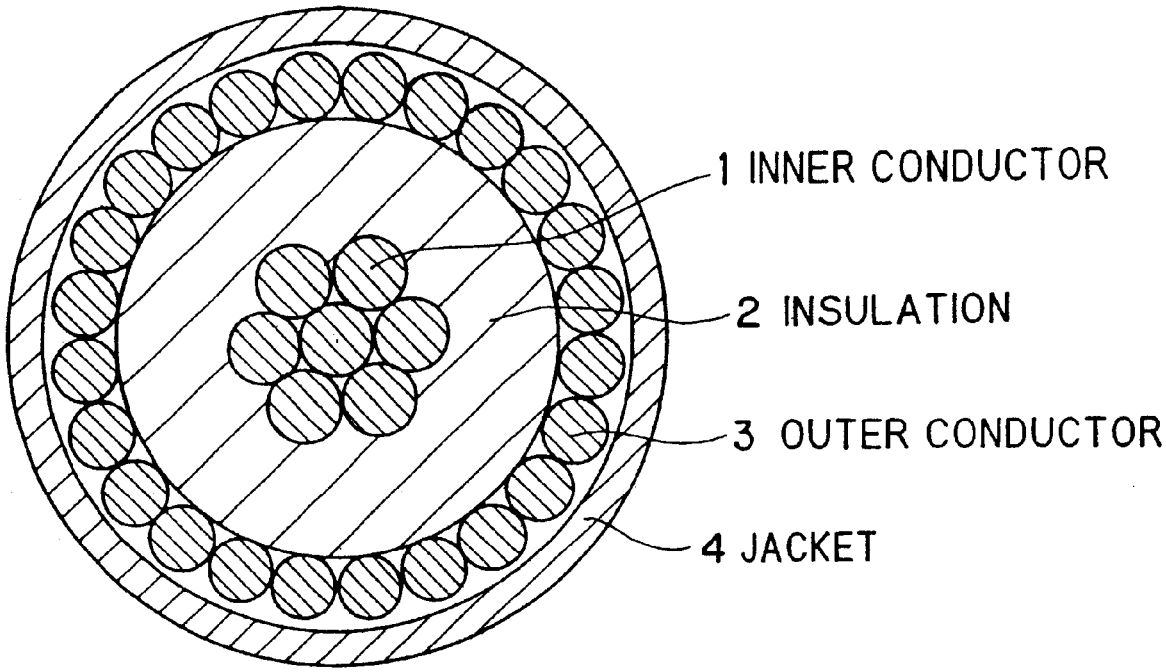
FIG. 1 is a sectional view of a micro coaxial cable using the ultrafine copper alloy wire according to the invention.

One preferred embodiment of the invention will be described.

The ultrafine copper alloy wire according to the invention is an ultrafine copper alloy wire according to the invention is an ultrafine copper alloy wire drawn to a diameter of not more than 0.08 mm, preferably not more than 0.025 mm, and is formed of an alloy (a high purity copper alloy) comprising a copper matrix of high purity copper with a total unavoidable impurity content of not more than 10 mass ppm, preferably not more than 1 mass ppm, and, contained in the matrix, 0.05 to 0.9 mass %, preferably 0.05 to 0.7 mass %, of at least one metallic element selected from the group consisting of tin, indium, silver, antimony, magnesium, aluminum, and boron.

According to the invention, an ultrafine copper alloy wire having a tensile strength of not less than 700 Mpa and an electrical conductivity of not less than 70% IACS can be provided by specifying the metallic element contained in the copper matrix and the content of the metallic element.

The use of a high purity copper having a total unavoidable impurity content of not more than 10 mass ppm, preferably not more than 1 mass ppm, as a material for constituting the copper matrix can reduce the content of the foreign materials in wires formed of the high purity copper alloy as compared with the content of foreign materials in wires formed of the conventional oxygen-free copper alloy. Therefore, ultrafine copper alloy wires having good drawability can be realized.

Next, the production process according to the invention will be described.

At the outset, a high purity copper having a total unavoidable impurity content of not more than 10 mass ppm is melted in a carbon crucible. At least one metallic element selected from the group consisting of tin, indium, silver, antimony, magnesium, aluminum, and boron is then added to the molten high purity copper to prepare a molten high purity copper alloy wherein the content of the metallic element in the copper matrix has been regulated to 0.05 to 0.9 mass %, preferably 0.05 to 0.7 mass %.

The molten high purity copper alloy is then poured into a carbon mold and is continuously cast into a wire rod.

Next, the wire rod is subjected to primary wire drawing. The drawn wire is then annealed by electric heating. The annealed drawn wire is subjected to secondary wire drawing to prepare an ultrafine copper alloy wire having a diameter of not more than 0.08 mm, preferably not more than 0.025 mm.

Here the carbon crucible and the carbon mold are not limited to crucibles and molds which are entirely constituted by graphite, and, of course, include crucibles and molds wherein only the surface of them is covered with graphite, crucibles and molds which are entirely formed of a carbon fiber or a carbon fiber sheet, and crucibles and molds wherein only the surface of them is covered with a carbon fiber or a carbon fiber sheet.

The annealing treatment method is not particularly limited to electric heating, and any of methods commonly used in annealing may be used.

In the process for producing an ultrafine copper alloy wire according to the invention, the use of the carbon crucible and the carbon mold respectively in melting of a high purity copper alloy and casting of a molten high purity copper alloy can avoid unfavorable phenomenon, which is often found in the prior art technique, that is, the inclusion of peeled pieces of refractories constituting the crucible and/or the mold in the molten high purity copper alloy during melting and casting. This can realize ultrafine copper alloy wires having improved drawability.

Next, another preferred embodiment of the invention will be described.

The ultrafine copper alloy wire according to another preferred embodiment of the invention comprises: a core wire formed of an alloy and drawn to a diameter of not more than 0.08 mm, preferably not more than 0.025 mm, the alloy comprising a copper matrix of high purity copper with a total unavoidable impurity content of not more than 10 mass ppm, preferably not more than 1 mass ppm, and, contained in the matrix, 0.05 to 0.9 mass %, preferably 0.05 to 0.7 mass %, of at least one metallic element selected from the group consisting of tin, indium, silver, antimony, magnesium, aluminum, and boron; and, provided on the periphery of the core wire, a tin plating, a silver plating, a nickel plating, a tin-lead solder plating, a tin-copper-bismuth-base plating, or a tin-silver-copper-base lead-free solder plating.

Here the plating may be formed by any method without particular limitation, that is, by any of methods commonly used in plating.

This preferred embodiment can, of course, offer substantially the same effect as the first preferred embodiment of the invention, and the tensile strength or the electrical conductivity can be further improved according to the properties required of the ultrafine copper alloy wire.

Figure 2:
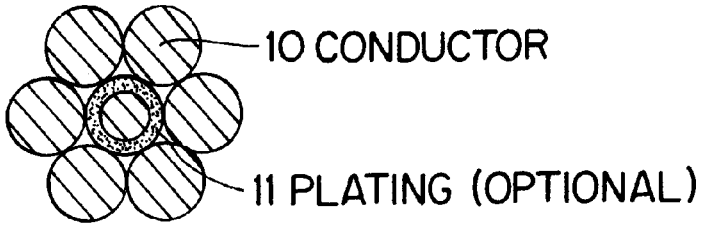
FIG. 2 is a sectional view of an electrical wire using the ultrafine copper alloy wire according to the present invention.

An electric wire is shown in FIG. 2. Using an ultrafine copper alloy wire according to a preferred embodiment of the invention the electric wire comprises a plurality of ultrafine copper alloy wires stranded together to form conductor 10, the ultrafine copper alloy wires each having been drawn to a diameter of not more than 0.08 mm, preferably not more than 0.025 mm, and being formed of an alloy comprising a copper matrix of high purity copper with a total unavoidable impurity content of not more than 10 mass ppm, preferably not more than 1 mass ppm, and, contained in the matrix, 0.05 to 0.9 mass %, preferably 0.05 to 0.7 mass %, of at least one metallic element selected from the group consisting of tin, indium, silver, antimony, magnesium, aluminum, and boron.

According to this preferred embodiment, an electric wire for medical ultrasound system can be realized wherein, despite the same outer diameter as the conventional electric wires, the number of wire cores is larger than that of the conventional electric wires.

An electric wire as shown in FIG. 2 using an ultrafine copper alloy wire according to a further preferred embodiment of the invention comprises a plurality of ultrafine copper alloy wires stranded together to form conductor 10, the ultrafine copper alloy wires each comprising: a core wire formed of an alloy and drawn to a diameter of not more than 0.08 mm, preferably not more than 0.025 mm, the alloy comprising a copper matrix of high purity copper with a total unavoidable impurity content of not more than 10 mass ppm, preferably not more than 1 mass ppm, and, contained in the matrix, 0.05 to 0.9 mass %, preferably 0.05 to 0.7 mass %, of at least one metallic element selected from the group consisting of tin, indium, silver, antimony, magnesium, aluminum, and boron; and, provided on the periphery of the core wire, a tin plating, a silver plating, a nickel plating, a tin-lead solder plating, a tin-copper-bismuth plating, or a tin-silver-copper-base lead-free solder plating, depicted as optional plating 11.

The electric wire according to this embodiment can, of course, offer substantially the same effect as the electric wire according to the preferred embodiment described just above, and the tensile strength or the electrical conductivity can be further improved according to the properties required of electric wires.

EXAMPLES

Example 1

A high purity copper having a copper content of 99.9999 mass % and a total unavoidable impurity content of 0.5 mass ppm was pickled with acid, and then placed within a carbon crucible, followed by vacuum melting in a small continuous casting system. Upon complete melting of copper, the atmosphere in the chamber was replaced by argon gas, and metallic elements were added to the crucible.

After the added metallic elements were completely dissolved in the molten copper, the molten metal was held for several minutes, and then continuously cast using a carbon mold into a wire rod having a chemical composition of copper-0.20tin -0.20indium and a diameter of 8.0 mmϕ. The wire rod was subjected to primary wire drawing to prepare a wire material having a diameter of 0.9 mmϕ which was then annealed by electric heating. The annealed wire material was then subjected to secondary wire drawing to prepare an ultrafine copper alloy wire having a diameter of 0.02 mmϕ.

Example 2

An ultrafine copper alloy wire was prepared in the same manner as in Example 1, except that a wire rod having a chemical composition of copper-0.30tin and a diameter of 8.0 mmϕ was prepared.

Example 3

An ultrafine copper alloy wire was prepared in the same manner as in Example 1, except that a high purity copper having a copper content of 99.9999 mass % and a total unavoidable impurity content of 0.5 mass ppm was used to prepare a wire rod having a chemical composition of copper-0.60indium and a diameter of 8.0 mmϕ.

Example 4

An ultrafine copper alloy wire was prepared in the same manner as in Example 1, except that a wire rod having a chemical composition of copper-0.20silver and a diameter of 8.0 mmϕ was prepared.

Example 5

An ultrafine copper alloy wire was prepared in the same manner as in Example 1, except that a high purity copper having a copper content of 99.9999 mass % and a total unavoidable impurity content of 0.7 mass ppm was used to prepare a wire rod having a chemical composition of copper-0.10antimony and a diameter of 8.0 mmϕ.

Example 6

An ultrafine copper alloy wire was prepared in the same manner as in Example 1, except that a wire rod having a chemical composition of copper-0.03tin-0.02magnesium and a diameter of 8.0 mmϕ was prepared.

Example 7

An ultrafine copper alloy wire was prepared in the same manner as in Example 1, except that a wire rod having a chemical composition of copper-0.30tin-0.02aluminum and a diameter of 8.0 mmϕ was prepared.

Example 8

An ultrafine copper alloy wire was prepared in the same manner as in Example 1, except that a high purity copper having a copper content of 99.9999 mass % and a total unavoidable impurity content of 0.7 mass ppm was used to prepare a wire rod having a chemical composition of copper-0.20magnesium-0.10zinc and a diameter of 8.0 mmϕ.

Example 9

An ultrafine copper alloy wire was prepared in the same manner as in Example 1, except that a high purity copper having a copper content of 99.9999 mass % and a total unavoidable impurity content of 0.6 mass ppm was used to prepare a wire rod having a chemical composition of copper-0.30tin-0.02boron and a diameter of 8.0 mmϕ.

Comparative Example 1

An oxygen-free copper having a copper content of 99.99 mass % and a total unavoidable impurity content of 14.0 mass ppm was placed within an SiC crucible, followed by melting in the air. After copper was completely melted, metallic elements were added to the crucible.

After the added metallic elements were completely dissolved in the molten copper, the molten metal was held for several minutes, and then continuously cast by SCR into a wire rod having a chemical composition of copper-0.19tin-0.20indium and a diameter of 11.0 mmϕ. The wire rod was scaled, and then subjected to primary wire drawing to prepare a wire material having a diameter of 0.9 mmϕ which was then annealed by electric heating. The annealed drawn wire material was then subjected to secondary wire drawing to prepare an ultrafine copper alloy wire having a diameter of 0.02 mmϕ.

Comparative Example 2

An ultrafine copper alloy wire was prepared in the same manner as in Comparative Example 1, except that an oxygen-free copper having a copper content of 99.99 mass % and a total unavoidable impurity content of 18.0 mass ppm was used to prepare a wire rod having a chemical composition of copper-0.30tin and a diameter of 11.0 mmϕ.

Comparative Example 3

An ultrafine copper alloy wire was prepared in the same manner as in Comparative Example 1, except that an oxygen-free copper having a copper content of 99.99 mass % and a total unavoidable impurity content of 20.0 mass ppm was used to prepare a wire rod having a chemical composition of copper-2.0tin and a diameter of 11.0 mmϕ.

Comparative Example 4

An ultrafine copper alloy wire was prepared in the same manner as in Comparative Example 1, except that an oxygen-free copper having a copper content of 99.99 mass % and a total unavoidable impurity content of 0.6 mass ppm was used to prepare a wire rod having a chemical composition of copper-0.02tin and a diameter of 11.0 mmϕ.

Data (chemical composition (mass %) and total content (mass ppm) of unavoidable impurities in copper material (copper as raw material)) on the ultrafine copper alloy wires prepared in Examples 1 to 9 and Comparative Examples 1 to 4 are summarized in Table 1.

TABLE 1

| | | Items Chemical composition, wt % | | | | | | | | | Total content of unavoidable impurities in Cu |
|---|---|---|---|---|---|---|---|---|---|---|---|
| | | Sn | In | Ag | Sb | Mg | Al | Zn | B | Cu | material, mass ppm |
| Ex. | 1 | 0.20 | 0.20 | — | — | — | — | — | — | Balance | 0.5 |
| | 2 | 0.30 | — | — | — | — | — | — | — | Balance | 0.5 |
| | 3 | — | 0.60 | — | — | — | — | — | — | Balance | 0.6 |
| | 4 | — | — | 0.20 | — | — | — | — | — | Balance | 0.5 |
| | 5 | — | — | — | 0.10 | — | — | — | — | Balance | 0.7 |
| | 6 | 0.03 | — | — | — | 0.02 | — | — | — | Balance | 0.5 |
| | 7 | 0.30 | — | — | — | — | 0.02 | — | — | Balance | 0.5 |
| | 8 | — | — | — | — | 0.20 | — | 0.10 | — | Balance | 0.7 |
| | 9 | 0.30 | — | — | — | — | — | — | 0.02 | Balance | 0.6 |
| Comp. Ex. | 1 | 0.19 | 0.20 | — | — | — | — | — | — | Balance | 14.0 |
| | 2 | 0.30 | — | — | — | — | — | — | — | Balance | 18.0 |
| | 3 | 2.00 | — | — | — | — | — | — | — | Balance | 20.0 |
| | 4 | 0.02 | — | — | — | — | — | — | — | Balance | 0.6 |

Next, the ultrafine copper alloy wires prepared in Examples 1 to 9 and Comparative Examples 1 to 4 were evaluated for tensile strength (MPa) , electrical conductivity (% IACS) and drawability, and, in addition, the overall evaluation for these properties was carried out. The results are summarized in Table 2.

In the evaluation of the drawability, 1 kg of a base material for each of the ultrafine copper alloy wires having a diameter of 0.02 mmϕ was subjected to wire drawing. When the base material was drawn to a length of not less than 50,000 m without breaking, the wire drawability was evaluated as ○, whereas, when breaking occurred before the length reached 50,000 m, the wire drawability was evaluated as Δ.

TABLE 2

| | Items | Tensile strength, MPa | Electrical conductivity, % IACS | Wire drawability | Overall evaluation |
|---|---|---|---|---|---|
| Ex. | 1 | 730 | 78.7 | ○ | ○ |
| | 2 | 725 | 76.5 | ○ | ○ |
| | 3 | 740 | 87.3 | ○ | ○ |
| | 4 | 780 | 97.0 | ○ | ○ |
| | 5 | 800 | 78.0 | ○ | ○ |
| | 6 | 750 | 90.5 | ○ | ○ |
| | 7 | 733 | 75.0 | ○ | ○ |
| | 8 | 800 | 78.0 | ○ | ○ |
| | 9 | 725 | 76.0 | ○ | ○ |
| Comp. Ex. | 1 | 790 | 78.5 | Δ | x |
| | 2 | 785 | 76.5 | Δ | x |
| | 3 | 1000 | 36.0 | Δ | x |
| | 4 | 600 | 98.0 | ○ | x |

As shown in Table 2, all the ultrafine copper alloy wires prepared in Examples 1 to 9, wherein the content of unavoidable impurities in the copper material, the content of the metallic element, and the material for the crucible and the mold had been specified, had a tensile strength of not less than 700 MPa, an electrical conductivity of not less than 70% IACS, and good drawability.

On the other hand, for the ultrafine copper alloy wires prepared in Comparative Examples 1 and 2, although the tensile strength and the electrical conductivity were not less than 700 MPa and not less than 70% IACS, respectively, the drawability was not good due to the fact that the total content of unavoidable impurities in the copper material was 14.0 mass ppm for Comparative Example 1 and 18.0 mass ppm for Comparative Example 2 which were larger than the specified total unavoidable impurity content range (not more than 10 mass ppm).

The ultrafine copper alloy wire prepared in Comparative Example 3 had the highest tensile strength (1,000 MPa) among the ultrafine copper alloy wires prepared in the examples and the comparative examples. However, due to the fact that the total content of unavoidable impurities in the copper material was 20.0 mass ppm which was larger than the specified total unavoidable impurity content range and, in addition, the metallic element content was 2.00 mass % which was larger than the specified metallic element content range (0.05 to 0.9 mass %), this ultrafine copper alloy wire had the lowest electrical conductivity (36.0% IACS) among the ultrafine copper alloy wires prepared in the examples and the comparative examples and, at the same time, had poor drawability without heat treatment.

The ultrafine copper alloy wire prepared in Comparative Example 4 had the highest electrical conductivity (98.0% IACS) among the ultrafine copper alloy wires prepared in the examples and the comparative examples and, at the same time, had good drawability. However, due to the fact that the metallic element content was 0.02 mass % which was lower than the specified range, this ultrafine copper alloy wire had the lowest tensile strength (600 MPa) among the ultrafine copper

TABLE 2

| | Items | Tensile strength, MPa | Electrical conductivity, % IACS | Wire drawability | Overall evaluation |
|---|---|---|---|---|---|
| Ex. | 1 | 730 | 78.7 | ○ | ○ |
| | 2 | 725 | 76.5 | ○ | ○ |
| | 3 | 740 | 87.3 | ○ | ○ |
| | 4 | 780 | 97.0 | ○ | ○ |
| | 5 | 800 | 78.0 | ○ | ○ |
| | 6 | 750 | 90.5 | ○ | ○ |
| | 7 | 733 | 75.0 | ○ | ○ |
| | 8 | 800 | 78.0 | ○ | ○ |
| | 9 | 725 | 76.0 | ○ | ○ |
| Comp. Ex. | 1 | 790 | 78.5 | Δ | x |
| | 2 | 785 | 76.5 | Δ | x |
| | 3 | 1000 | 36.0 | Δ | x |
| | 4 | 600 | 98.0 | ○ | x |

As shown in Table 2, all the ultrafine copper alloy wires prepared in Examples 1 to 9, wherein the content of unavoidable impurities in the copper material, the content of the metallic element, and the material for the crucible and the mold had been specified, had a tensile strength of not less than 700 MPa, an electrical conductivity of not less than 70% IACS, and good drawability.

On the other hand, for the ultrafine copper alloy wires prepared in Comparative Examples 1 and 2, although the tensile strength and the electrical conductivity were not less than 700

TABLE 2

| | Items | Tensile strength, MPa | Electrical conductivity, % IACS | Wire drawability | Overall evaluation |
|---|---|---|---|---|---|
| Ex. | 1 | 730 | 78.7 | ○ | ○ |
| | 2 | 725 | 76.5 | ○ | ○ |
| | 3 | 740 | 87.3 | ○ | ○ |
| | 4 | 780 | 97.0 | ○ | ○ |
| | 5 | 800 | 78.0 | ○ | ○ |
| | 6 | 750 | 90.5 | ○ | ○ |
| | 7 | 733 | 75.0 | ○ | ○ |
| | 8 | 800 | 78.0 | ○ | ○ |
| | 9 | 725 | 76.0 | ○ | ○ |
| Comp. Ex. | 1 | 790 | 78.5 | Δ | x |
| | 2 | 785 | 76.5 | Δ | x |
| | 3 | 1000 | 36.0 | Δ | x |
| | 4 | 600 | 98.0 | ○ | x |

As shown in Table 2, all the ultrafine copper alloy wires prepared in Examples 1 to 9, wherein the content of unavoidable impurities in the copper material, the content of the metallic element, and the material for the crucible and the mold had been specified, had a tensile strength of not less than 700 MPa, an electrical conductivity of not less than 70% IACS, and good drawability.

On the other hand, for the ultrafine copper alloy wires prepared in Comparative Examples 1 and 2, although the tensile strength and the electrical conductivity were not less than 700 alloy wires prepared in the examples and the comparative examples.

That is, the ultrafine copper alloy wires prepared in Comparative Examples 1 to 4 were unsatisfactory in at least one of the tensile strength, the electrical conductivity, and the drawability.

Example 10

A micro coaxial cable as shown in FIG. 1 was prepared as follows. In FIG. 1, numeral 1 designates an inner conductor, numeral 2 an insulation, numeral 3 an outer conductor, and numeral 4 a jacket.

An ultrafine copper alloy wire was prepared in the same manner as in Example 1, except that the final diameter of the ultrafine copper alloy wire after the secondary wire drawing was 0.025 mm. Seven ultrafine copper alloy wires of this type were stranded together to prepare a stranded wire. This stranded wire was used as the inner conductor 1. A fluororesin (FEP, PFA, or ETFE) was extruded onto the inner conductor 1 to form the insulation 2 having a thickness of 0.06 mm which covered the periphery of the inner conductor 1. 24 ultrafine copper alloy wires having a diameter of 0.025 mm of the type prepared above were spirally wound around the insulation layer 2 at predetermined pitches to form the outer conductor 3. Next, a 0.02 mm-thick PET tape was covered as the jacket 4 on the outside of the outer conductor 3. Thus, a micro coaxial cable having an outer diameter of 0.274 mm was prepared.

A metal tape layer (not shown) may be provided between the outer conductor 3 and the jacket 4. Ultrafine copper alloy wires having an outer diameter of 0.015 to 0.03 mm, preferably 0.015 to 0.025 mm, may be used for constituting the inner conductor 1. Ultrafine copper alloy wires having an outer diameter of 0.015 to 0.04 mm, preferably 0.015 to 0.025 mm, may be used for constituting the outer conductor 3. The outer diameter of the micro coaxial cable may be 0.15 to 0.3 mm.

In summary, the invention has the following excellent effects.

(1) Ultrafine copper alloy wires having excellent tensile strength, electrical conductivity, and drawability can be realized by using a high purity copper having a total unavoidable impurity content of not more than 10 mass ppm and, in addition, specifying a metallic element added to a copper matrix and the content of the metallic element.

(2) The use of a carbon crucible and a carbon mold respectively in the melting of a high purity copper alloy and casting of the molten high purity copper alloy can avoid the inclusion of peeled pieces of the crucible and/or the mold in the molten high purity copper alloy during the melting and the casting.

The invention has been described in detail with particular reference to preferred embodiments, but it will be understood that variations and modifications can be effected within the scope of the invention as set forth in the appended claims.

What is claimed is:

1. An ultrafine copper alloy wire, comprising a drawn diameter of not more than the 0.025 mm; and an alloy having a copper matrix of high purity copper with a total unavoidable impurity content of not more than 10 mass ppm and, contained in the matrix, 0.05 to 0.9 mass % of at least one metallic element selected from the group consisting of tin, indium, silver, antimony, magnesium, aluminum, and boron.

2. An ultrafine copper alloy wire according to claim 1, wherein the ultrafine copper alloy wire is one of a plurality of ultrafine copper alloy wires forming an inner conductor of a micro coaxial cable.

3. An ultrafine copper alloy wire according to claim 1, wherein the ultrafine copper alloy wire is one of a plurality of ultrafine copper alloy wires forming an outer conductor of a micro coaxial cable.

4. An ultrafine copper alloy wire, a core wire formed of an alloy and having a drawn diameter of not more than 0.025 mm, said alloy including a copper matrix of high purity copper with a total unavoidable impurity content of not more than 10 mass ppm and, contained in the matrix, 0.05 to 0.9 mass % of at least one metallic element selected from the group consisting of tin, indium, silver, antimony, magnesium, aluminum, and boron; and a tin plating, a silver plating, a nickel plating, a tin lead soldier plating, a tin-copper-bismuth-base plating, or a tin-silver-copper-base lead-free solder plating provided on a periphery of the core wire.

5. An ultrafine copper alloy wire according to claim 4, wherein the ultrafine copper alloy wire is one of a plurality of ultrafine copper alloy wires forming an inner conductor of a micro coaxial cable.

6. An ultrafine copper alloy wire according to claim 4, wherein the ultrafine copper alloy wire is one of a plurality of ultrafine copper alloy wires forming an outer conductor of a micro coaxial cable.

7. An electric wire, comprising:

a plurality of ultraflne copper alloy wires stranded together; and each of said ultrafine copper alloy wires having a drawn diameter of not more than 0.025 mm, and being formed of an alloy including a copper matrix of high purity copper with a total unavoidable impurity content of not more than 10 mass ppm and, contained in the matrix, 0.05 to 0.9 mass % of at least one metallic element selected from the group consisting of tin, indium, silver, antimony, magnesium, aluminum, and boron.

8. An electric wire, comprising:

a plurality of ultrafine copper alloy wires stranded together;

a core wire, included as part of the plurality of wires, formed of an alloy and having a drawn diameter of not more than 0.025 mm, said alloy including a copper matrix of high purity copper with a total unavoidable impurity content of not more than 10 mass ppm and, contained in the matrix, 0.05 to 0.9 mass % of at least one metallic element selected from the group consisting of tin, indium, silver, antimony, magnesium, aluminum, and boron; and a tin plating, a silver plating, a nickel plating, a tin lead soldier plating, a tin-copper-bismuth-base plating, or a tin-silver-copper-base lead-free solder plating provided on a periphery of the core wire.

9. A coaxial cable, comprising:

an inner conductor including one of (i) a plurality of stranded together ultrafine copper alloy wires, each of the wires having a drawn diameter of not more than 0.025 mm, and an alloy with a copper matrix of high purity copper with a total unavoidable impurity content of not more than 10 mass ppm and, contained in the matrix, 0.05 to 0.9 mass % of at least one metallic element selected from the group consisting of tin, indium, silver, antimony, magnesium, aluminum, and boron, and (ii) a plurality of stranded together ultrafine copper alloy wires, each of wires having a core wire formed of an alloy with a drawn diameter of not more than 0.025 mm, the alloy including a copper matrix of high purity copper with a total unavoidable impurity content of not more than 10 mass ppm and, contained in the matrix, 0.05 to 0.9 mass % of at least one metallic element selected form the group consisting of tin, indium, silver, antimony, magnesium, aluminum, and boron, and having one of a tin plating, a silver plating, a nickel plating, a tin-lead solder plating, a tin-copper-bismuth-base plating, and a tin-silver-copper-base lead-free solder plating on a periphery of the core wire;

an insulation layer covering the inner conductor;

an outer conductor including a plurality of ultrafine copper alloy wires spirally wound on the insulation layer at predetermined pitches; and a jacket forming an outermost layer of the cable.

10. A coaxial cable according to claim 9, wherein:

each of the plurality of ultrafine copper alloy wires included the outer conductor is one of (i) an ultrafine copper alloy wire having a drawn diameter of not more than 0.025 mm, and an alloy with a copper matrix of high purity copper with a total unavoidable impurity content of not more than 10 mass ppm and, contained in the matrix, 0.05 to 0.9 mass % of at least one metallic element selected from the group consisting of tin, indium, silver, antimony, magnesium, aluminum, and boron, and (ii) an ultrafine copper alloy wire having a core wire formed of an alloy with a drawn diameter of not more than 0.025 mm, the alloy including a copper matrix of high purity copper with a total unavoidable impurity content of not more than 10 mass ppm and, contained in the matrix, 0.05 to 0.9 mass % of at least one metallic element selected form the group consisting of tin, indium, silver, antimony, magnesium, aluminum, and boron, and having one of a tin plating, a silver plating, a nickel plating, a tin-lead solder plating, a tin-copper-bismuth-base plating, and a tin-silver-copper-base lead-free solder plating on a periphery of the core wire.

* * * * *